US008967261B2

(12) United States Patent
Cassidy

(10) Patent No.: US 8,967,261 B2
(45) **Date of Patent: *Mar. 3, 2015**

(54) OIL SHALE PROCESSING

(76) Inventor: Peter James Cassidy, Roseville (AU)

( * ) Notice: Subject to any disclaimer, the term of this patent is extended or adjusted under 35 U.S.C. 154(b) by 246 days.

This patent is subject to a terminal disclaimer.

(21) Appl. No.: 12/995,593

(22) PCT Filed: Dec. 11, 2009

(86) PCT No.: PCT/AU2009/001613

§ 371 (c)(1),
(2), (4) Date: Feb. 8, 2011

(87) PCT Pub. No.: WO2010/096855

PCT Pub. Date: Sep. 2, 2010

(65) Prior Publication Data

US 2011/0186296 A1 Aug. 4, 2011

(30) Foreign Application Priority Data

Feb. 25, 2009 (AU) ..... 2009900822

(51) Int. Cl.

| | |
|---|---|
| ***E21B 43/24*** | (2006.01) |
| ***C10G 1/02*** | (2006.01) |
| ***C10G 1/04*** | (2006.01) |
| ***C10G 1/06*** | (2006.01) |
| ***C10G 1/08*** | (2006.01) |

(52) U.S. Cl.

CPC .. *C10G 1/02* (2013.01); *C10G 1/04* (2013.01); *C10G 1/042* (2013.01); *C10G 1/047* (2013.01); *C10G 1/06* (2013.01); *C10G 1/065* (2013.01); *C10G 1/08* (2013.01); *C10G 1/083* (2013.01); *C10G 1/086* (2013.01); *C10G 2300/1025* (2013.01); *C10G 2300/4037* (2013.01); *C10G 2300/805* (2013.01)

USPC ..... 166/303; 166/302

(58) Field of Classification Search

CPC ..... E21B 43/24; C10G 1/02; C10G 1/04; C10G 1/042; C10G 1/086

USPC ..... 166/302, 303

See application file for complete search history.

(56) References Cited

U.S. PATENT DOCUMENTS

| | | | | | |
|---|---|---|---|---|---|
| 3,617,472 | A | * | 11/1971 | Schlinger et al. | 208/414 |
| 3,753,594 | A | | 8/1973 | Beard | |
| 3,759,574 | A | * | 9/1973 | Beard | 299/4 |
| 3,952,801 | A | * | 4/1976 | Burton, III | 166/256 |
| 4,065,183 | A | * | 12/1977 | Hill et al. | 299/4 |
| 4,083,604 | A | * | 4/1978 | Bohn et al. | 299/4 |
| 6,591,908 | B2 | * | 7/2003 | Nasr | 166/272.3 |
| 6,722,431 | B2 | * | 4/2004 | Karanikas et al. | 166/251.1 |
| 7,647,971 | B2 | * | 1/2010 | Kaminsky | 166/302 |
| 2007/0246994 | A1 | | 10/2007 | Kaminsky et al. | |
| 2009/0050319 | A1 | | 2/2009 | Kaminsky et al. | |

OTHER PUBLICATIONS

International Search Report for PCT/AU2009/001613 completed Feb. 1, 2010.

* cited by examiner

*Primary Examiner* — Zakiya W Bates
*Assistant Examiner* — Silvana Runyan
(74) *Attorney, Agent, or Firm* — Brannon Sowers & Cracraft PC

(57) ABSTRACT

A method of in-situ processing of a subterranean oil shale formation to produce hydrocarbons comprising contacting the oil shale with (i) a carbon monoxide/water mixture or (ii) a carbon monoxide/water/hydrogen mixture together with at least one liquefaction promoter, under pressure and heat to produce hydrocarbons.

30 Claims, No Drawings

OIL SHALE PROCESSING

CROSS-REFERENCE TO RELATED APPLICATIONS

This application is a U.S. national counterpart application of International Application Serial No. PCT/AU2009/001613, filed Dec. 11, 2009, which claims priority to Australian Patent Application No. 2009900822, filed Feb. 25, 2009. The disclosures of both PCT/AU2009/001613 and AU2009900822 are hereby incorporated herein by reference.

TECHNICAL FIELD

The present invention relates to a method of in-situ processing of oil shale and to hydrocarbons produced by the method.

BACKGROUND OF THE INVENTION

The information provided herein is provided solely to assist the understanding of the reader, and do not constitute an admission that any of the information is prior art to the present invention.

There is a need for hydrocarbon energy sources as feedstocks and in consumer products and a growing concern over the depletion of the presently available hydrocarbon resources and declining quality of the hydrocarbons produced. There is therefore a need for the recovery of hydrocarbons from other sources in an efficient and cost-effective manner. One suitable source of hydrocarbons is oil shale found in subterranean sedimentary formations.

Oil shale is commonly defined as a fine-grained sedimentary rock containing organic matter (kerogen) that yields substantial amounts of oil and combustible gas upon destructive distillation or exposure to heat. Kerogen is a solid, insoluble hydrocarbon that has been converted by natural degradation (e.g., by diagenesis) and that principally contains carbon, hydrogen, nitrogen, oxygen, and sulfur. Most of the organic matter is insoluble in ordinary organic solvents and it must be decomposed by heating to release such materials.

Oil shale deposits are found throughout the world. They range in age from Cambrian to Tertiary and were formed in a variety of marine, continental and lacustrine-depositional environments. For example large areas of north-western Colorado, north-eastern Utah and south-western Wyoming are known to contain very large deposits of oil rich shale. Much of this oil rich shale is situated in the Mahogany Zone at a depth of approximately 1475 ft (450 m) and is estimated to contain 213 billion tons of in-situ shale oil. Within Colorado is the Piceance Basin. This basin contains an upper bedrock stratigraphy of basin-fill sediments from the tertiary period containing sandstone, siltstone and marlstone. Below it is the Green River Formation which may be up to 5000 ft (1525 m) thick. It contains keragenous dolomitic marlstone and shale, sandstone, claystone, siltstone and clay-rich oil shale. The grade of oil shale varies with location and depth. In some areas, substantial quantities of saline minerals such as nahcolite, dawsonite and halite are intermixed or intermingled with the oil shale. Nahcolite (sodium bicarbonate—$NaHCO_3$) generally occurs at proportions less than 5 wt % however in lower oil shale zones it may average more than 30 wt %. Dawsonite (dihydroxy sodium aluminium carbonate—$NaAl(OH)_2CO_3$) and other saline minerals may be present in amounts up to 15 wt % (3 to 5 wt % on average).

Because of the depth of the oil shale and the thermal decomposition of nahcolite and dawsonite, it is generally considered that it would not be viable to conventionally mine and process the oil shale in an economical or environmentally friendly manner above ground.

It would be desirable to find a method for in-situ processing of oil shales.

SUMMARY OF THE INVENTION

According to a first aspect of the present invention, there is provided a method of in-situ processing of a subterranean oil shale formation to produce hydrocarbons comprising contacting the oil shale with (i) a carbon monoxide/water mixture or (ii) a carbon monoxide/water/hydrogen mixture together with at least one liquefaction promoter, under pressure and heat to produce hydrocarbons.

According to a second aspect of the present invention, there is provided a method of in-situ processing of a subterranean oil shale formation containing nahcolite to produce hydrocarbons comprising removing the nahcolite by solution mining to produce rubblized oil shale and creating a high temperature and high pressure reactor within the subterranean oil shale formation and contacting the oil shale with (i) a carbon monoxide/water mixture or (ii) a carbon monoxide/hydrogen/water mixture in the presence of at least one liquefaction promoter, under pressure and heat to produce hydrocarbons.

According to a third aspect of the present invention, there is provided a method of processing a subterranean oil shale formation containing nahcolite comprising removing the nahcolite by solution mining to produce rubblized oil shale, removing the rubblized oil shale as a slurry and treating the rubblized oil shale with (i) a carbon monoxide/water or (ii) carbon monoxide/hydrogen/water mixture in the presence of at least one liquefaction promoter, under pressure and heat to produce hydrocarbons.

DEFINITIONS

The following are some definitions that may be helpful in understanding the description of the present invention. These are intended as general definitions and should in no way limit the scope of the present invention to those terms alone, but are put forth for a better understanding of the following description.

Unless the context requires otherwise or specifically stated to the contrary, integers, steps or elements of the invention recited herein as singular integers, steps or elements clearly encompass both singular and plural forms of the recited integers, steps or elements.

Throughout this specification, unless the context requires otherwise, the word "comprise", or variations such as "comprises" or "comprising", will be understood to imply the inclusion of a stated step or element or integer or group of steps or elements or integers, but not the exclusion of any other step or element or integer or group of elements or integers. Thus, in the context of this specification, the term "comprising" means "including principally, but not necessarily solely".

By "rubblized" is meant that the oil shale is fractured into fragments of smaller size.

DETAILED DESCRIPTION OF PREFERRED EMBODIMENTS OF THE INVENTION

The present invention relates to a method of in-situ processing of a subterranean oil shale formation to produce hydrocarbons comprising contacting the oil shale with (i) a carbon monoxide/water mixture or (ii) a carbon monoxide/ water/hydrogen mixture together with at least one liquefaction promoter, under pressure and heat to produce hydrocarbons.

The present invention also relates to a method of in-situ processing of a subterranean oil shale formation containing nahcolite to produce hydrocarbons comprising removing the nahcolite by solution mining to produce rubblized oil shale and creating a high temperature and high pressure reactor within the subterranean oil shale formation and contacting the oil shale with (i) a carbon monoxide/water mixture or (ii) a carbon monoxide/hydrogen/water mixture in the presence of at least one liquefaction promoter, under pressure and heat to produce hydrocarbons.

The present invention also relates to a method of processing a subterranean oil shale formation containing nahcolite comprising removing the nahcolite by solution mining to produce rubblized oil shale, removing the rubblized oil shale as a slurry and treating the rubblized oil shale with (i) a carbon monoxide/water or (ii) carbon monoxide/hydrogen/water mixture in the presence of at least one liquefaction promoter, under pressure and heat to produce hydrocarbons.

In one embodiment the heat is generated by one or more heat sources placed in contact with the formation. The heat source heats a portion of the formation to a temperature that allows pyrolysis of the hydrocarbons. A water gas shift of the following $CO+H_2O \rightarrow CO_2+H_2$ aids in liquefaction of the oil shale. Hydrocarbons produced include oils and gases in the form of condensable and non-condensable hydrocarbons. Condensable hydrocarbons are generally considered as those hydrocarbons that condense at 25° C. and 1 atm absolute pressure. Condensable hydrocarbons may include a mixture of hydrocarbons having carbon numbers greater than 4. Non-condensable hydrocarbons are generally hydrocarbons that do not condense at 25° C. and 1 atm absolute pressure. Non-condensable hydrocarbons may include hydrocarbons having carbon numbers less than 5. Condensable hydrocarbons produced from the formation will typically include paraffins, cycloalkanes, alkylated and unalkylated mono- and di-aromatics, as major components. Condensable hydrocarbons may also include other components such as alkylated and unalkylated tri-aromatics. It is important to note here that the hydrocarbons produced are composed primarily of carbon and hydrogen but may also include other elements, such as, but not limited to, halogens, metallic elements, nitrogen, oxygen, and/or sulfur. Hydrocarbons produced may include, but are not limited to: bitumen, pyrobitumen, oils, natural mineral waxes and asphaltenes.

In one embodiment the temperature ranges from 250° C. to 450° C. In one embodiment the pressure of added carbon monoxide and/or hydrogen gas ranges from 0.2 MPa to 5 MPa measured at ambient temperatures and pressures. For example, in one embodiment the pressure of injected gas may range from 0.5 MPa to 4 MPa measured at ambient temperatures and pressures. In another embodiment the pressure of injected gas may range from 1 to 3 MPa measured at ambient temperatures and pressures. Temperature and pressure in at least a portion of the formation may be controlled during pyrolysis to yield improved products from the formation. In one embodiment depending on the temperature used, the reaction time may vary from 15 minutes to 3 hours at 350° C. and 1500 to 5000 hours (or longer) at 250° C.

The reaction is usually undertaken with an excess of water compared to kerogen. In one embodiment water to kerogen ratios of 1.01 to 25 are used. In another embodiment the water to kerogen ratios may be 2 to 6. In another embodiment the water to kerogen ratios may be 2 to 4.

The heat source used is any system for providing heat to at least a portion of a formation. The heat source is suitably placed in contact with the formation by means of a borehole or well drilled into the formation. The heat source includes, but is not limited to, electric heaters, burners, combustors (e.g., natural distributed combustors) that react with material in or produced from a formation, and/or combinations thereof. For example, a heat source may include electric heaters such as an insulated conductor, an elongated member, and/or a conductor disposed within a conduit. A heat source may also include heat sources that generate heat by burning a fuel external to or within a formation, such as surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to transfer media that directly or indirectly heat the formation. It is to be understood that one or more heat sources that are applying heat to a formation may use different sources of energy. In one embodiment methane is partially combusted to produce both heat and the carbon monoxide needed for the reaction. In one embodiment the heat source is a downhole burner using natural gas and/or process off gases as fuel. In another embodiment microwave heater(s) are used as the heat source. In one embodiment the method comprises incomplete combustion of the natural gas and/or process off gases to produce carbon monoxide as well as heat in-situ.

Hydrocarbons produced may be removed from the formation through one or more production wells. The hydrocarbons produced may be further processed by distilling the hydrocarbon fluids and separating the condensed fluids from the non-condensed fluids. When the hydrocarbon liquids are not upgraded, a mild hydrotreatment may optionally be performed as necessary on the surface after the liquids are produced and the resulting off gases may be burned as fuel instead of, or in addition to natural gas.

In one embodiment, the oil shale contains certain finely dispersed naturally occurring minerals, such as dawsonite and nahcolite. The invention is therefore suitable for processing oil shales containing one or more of nahcolite, halite, trona or dawsonite such as the oil shales found in the Green River Formation. When an oil shale is used that does not contain these minerals, nahcolite and/or dawsonite may be added to the oil shale before processing. In one embodiment, trona may be added to the oil shale before processing either alone or together with nahcolite and/or dawsonite. In one embodiment nahcolite and/or dawsonite may be added in a concentration of 0.1 to 5 mol/Kg oil shale. For example, in one embodiment nahcolite and/or dawsonite may be added in a concentration of 0.3 to 3 mol/Kg. In another embodiment, nahcolite and/or dawsonite may be added in a concentration of 1 to 1.5 mol/Kg.

In one embodiment the oil shale is contacted with a carbon monoxide/water mixture in the presence of dawsonite or its decomposition products. In one embodiment the decomposition products include, but are not limited to, sodium aluminate or hydrated aluminium oxide/hydroxide.

In one embodiment sodium aluminate may be added to the oil shale before processing. Sodium aluminate may be added together with nahcolite and/or dawsonite. In one embodiment sodium aluminate may be added in a concentration of 0.1 to 5 mol/Kg oil shale. For example, in one embodiment sodium aluminate may be added in a concentration of 0.3 to 3 mol/Kg. In another embodiment, sodium aluminate may be added in a concentration of 1 to 1.5 mol/Kg.

In one embodiment, when the oil shale contains nahcolite and/or dawsonite, the method comprises preparing a cavity by solution mining of the nahcolite and/or dawsonite. In one embodiment the nahcolite and dawsonite are recovered. In this regard, release of kerogen from oil shale typically requires high temperatures as described above. Temperatures in the range required have a detrimental effect on in-situ nahcolite converting it to sodium carbonate in the absence of water. In addition, in some areas, oil shale may be contained in a saline zone variously being layered, interbedded and dispersed throughout by nahcolite. In one embodiment, the development of cavities to facilitate kerogen removal, requires the removal of nahcolite before elevated temperatures are introduced. Accordingly, in one embodiment of the invention, the first step in an in-situ conversion process is the removal of sufficient nahcolite and/or dawsonite by solution mining. This leaves behind a cavity capable of withstanding reaction conditions that may be used as a reactor. In addition it has been discovered that in these cavities a significant amount of oil shale may be rubblized. It has also been discovered that some of the rubblized oil shale can be produced as a slurry in the product stream. Significant amounts of oil shale exist in the caverns created by solution mining in particulate form, making reactions easier to carry out. Thus in one embodiment, the process of the present invention is aimed at production of shale oil in-situ from rubblized shale in the cavities created by solution mining of nahcolite and/or dawsonite. It is also recognised that there is a potential for recovery of oil shale as a fine particulate slurry and processing the recovered oil shale above ground to produce a synthetic crude oil using the same CO/water or CO/water/hydrogen chemistry (the resulting crude oil can be used as plant fuel, for example for generating the hot water needed to solution mine nahcolite thereby reducing natural gas costs).

In one embodiment, the wells used to recover the nahcolite and/or dawsonite are used to introduce the reactants into the cavities. In one embodiment, methane (natural gas) and air are injected in separate pipes down the well, at the end of which is a down-hole burner. In one embodiment, the natural gas is partially combusted to produce carbon monoxide and heat. In one embodiment, the oil shale contains dawsonite which converts to sodium aluminate at elevated temperature. Since water is ubiquitous within the cavity, in one embodiment, the rubblized oil shale is pyrolysed under a CO/water atmosphere or CO/water/hydrogen atmosphere at in-situ pressures that exist down-hole and the liquids produced are pumped to the surface by another nearby well.

In one embodiment, microwave heaters are used as the heat source, which are tuned to the water in the reactor formed by the cavity.

In one embodiment, oil shale is contacted with a carbon monoxide/hydrogen/water mixture in the presence of at least one liquefaction promoter. The liquefaction promoter may be added to the carbon monoxide/hydrogen/water mixture or may be added separately. Suitable liquefaction promoters include, but are not limited to dawsonite, or its decomposition products, sodium aluminate, or water soluble metal compounds including a transitional metal or a hydrogen absorbing metal. Suitable transition metals include, but are not limited to, iron, nickel or copper. A suitable hydrogen absorbing metals includes, but is not limited to, tin. The metals may be added in the form of water soluble salts such as a chloride, sulphate or acetate salt. In one embodiment, the liquefaction promoter functions to enhance the liquefaction reaction in the presence of added hydrogen gas. In one embodiment, the liquefaction promoter is present in a range of between 0.001 mol/Kg to 1.0 mol/Kg of oil shale. In another embodiment, the liquefaction promoter is present in a range of between 0.001 mol/Kg to 0.5 mol/Kg of oil shale. In another embodiment, the liquefaction promoter is present in a range of between 0.01 mol/Kg to 0.5 mol/Kg of oil shale. If desired, a liquefaction promoter may also be used with the carbon monoxide/water mixture, either separately or together.

Sodium aluminate ($NaAlO_2$) may be included in the carbon monoxide/water mixture to catalyse the kerogen breakdown or sodium aluminate plus a liquefaction promoter may be included in the carbon monoxide/hydrogen/water mixture to catalyse the liquefaction reaction. However the added compounds may not always be needed as the oil shale itself may contain inorganic materials that may act as catalysts for the reaction of carbon monoxide/water or carbon monoxide/hydrogen/water with oil shale kerogen to aid in its conversion to liquids. In this regard, oil shales liquefy easily in CO/water when sodium aluminate is finely dispersed through the shale. For example, oil shale kerogen naturally impregnated with dawsonite is already conditioned to be liquefied under relatively mild conditions.

Based on the literature of using a CO/water system to convert coals, it is surprising that the CO/water system works with oil shale as it would be expected that the oil shale would require significant amounts of organically bound reactive oxygen linkages as is required for processing of coal. It is also surprising that the CO/water system works better than a comparable atmosphere of hydrogen. This may be because the reaction temperatures are relatively low so the hydrogen is not very reactive.

The present invention will now be described with reference to the following examples.

Example 1

Experimental Protocol

An experiment will be conducted to determine whether the carbon monoxide-water system will produce more liquids than use of hydrogen under the same set of conditions and use of nitrogen as an inert control.

Fresh oil shale samples from the Piceance region of Colorado and/or Jordanian oil shale will be obtained suitably of large fist size chunks in order to minimize the effects of oxidation. Oil shale from the Piceance region is embedded with significant amounts of dawsonite and nahcolite which may act like sodium aluminate and catalyse the water gas shift reaction. The Jordanian oil shale does not contain dawsonite or nahcolite and contains a high level of sulphur (>10% by weight based on kerogen).

The oil shale will then be subjected to the following conditions:

Temperature: 355° C.

Pressure: 3 MPa CO or $H_2$ or $N_2$ at ambient temperature and pressure

Reaction time: 1 hour

Feed charge: 5-10 g oil shale. In addition, 30 ml of water will be fed to keep the water to oil shale weight ratio at about 3

Feed size: <250 μM

Reactor: Either 100 ml stainless steel or Hastelloy C mini- or a 300 ml stirred stainless steel or Hastelloy C autoclave with a rapid hot-charge facility.

The crushed shale and water will be added to an autoclave with a charge of CO, rapidly brought to temperature, and allowed to react at temperature for 1 hour. On cooling the autoclave contents will be contacted with tetrahydrofuran (THF). The THF insoluble residue will be dried and weighed.

Conversion will be defined as (100%-% THF insoluble residue). This procedure will be repeated using hydrogen and then again using nitrogen.

The inventors believe conversions using CO/water with the oil shale will give higher conversions than that obtained with hydrogen. The result with nitrogen will be representative of thermal conversion only. A positive result will show that the THF insolubles are measurably higher for nitrogen and hydrogen runs relative to those from the CO/water reaction (i.e., conversion are lower than those from the CO/water reaction). The THF soluble material may be further fractionated into asphaltols (THF soluble; methylene chloride insoluble), asphaltenes (methylene chloride soluble; hexane insoluble) and oils (hexane soluble). Asphaltene and asphaltol yields will be compared from the CO/water, hydrogen and nitrogen experiments to get an indication of product quality. The lower the asphaltols and asphaltene levels, the higher the product quality.

Example 2

Experimental protocol 1 will be repeated with oil shale pretreated with sodium aluminate (this may be necessary particularly for an oil shale that does not inherently contain Dawsonite). A suitable concentration will be 1 mol/Kg oil shale. For the pre-treatment, 10 g of the crushed oil shale will be treated with a solution of 0.81 g of sodium aluminate (81 g/mol) dissolved in about 5-10 g of water (more if necessary to dissolve the sodium aluminate) for 24-48 hours, then the water will be removed at room temperature under high vacuum.

The foregoing description of preferred embodiments and best mode of the invention known to the applicant at the time of filing the application have been presented for the purposes of illustration and description. It is not intended to be exhaustive or to limit the invention to the precise form disclosed. Many modifications and variations are possible in the light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of in-situ processing of a subterranean oil shale formation comprising kerogen to produce hydrocarbons, the method comprising the steps of (a) contacting the oil shale with a mixture comprising carbon monoxide and water, and (b) contacting the oil shale with one or more liquefaction promoters, under pressure and heat to produce hydrocarbons.

2. The method according to claim 1 wherein the heat is generated by one or more heat sources placed in contact with the formation.

3. The method according to claim 2 wherein the heat source is placed in contact with the formation by means of a borehole or well drilled into the formation.

4. The method according to claim 3 wherein the heat source is a down-hole burner using natural gas, process off gases, or a combination thereof as fuel.

5. The method according to claim 4 wherein the method comprises incomplete combustion of the natural gas, the process off gases, or the combination thereof to produce carbon monoxide and heat in-situ.

6. The method according to claim 1 further comprising condensing the hydrocarbon fluids and separating the condensed fluids from the non-condensed fluids.

7. The method according to claim 1 wherein the oil shale contains one or more of nahcolite, halite, trona or dawsonite.

8. The method according to claim 7 further comprising preparing a cavity by solution mining of nahcolite, dawsonite, or a combination thereof.

9. The method according to claim 1 wherein at least one liquefaction promoter is selected from the group consisting of nahcolite, dawsonite, sodium aluminate, or a combination thereof.

10. The method according to claim 9 wherein nahcolite, dawsonite, sodium aluminate, or a combination thereof is added in a concentration of 0.1 to 5 mol/Kg oil shale.

11. The method according to claim 1 wherein the formation is heated to a temperature of 250° C. to 450° C.

12. The method according to claim 1 wherein the pressure of added carbon monoxide gas is 0.2 MPa to 5 MPa measured at ambient temperature.

13. The method according to claim 1 wherein the amount of water in the contacting step is greater than the amount of exposed kerogen.

14. The method according to claim 13 wherein the ratio of water to exposed kerogen is in the range from 1.01 to 25.

15. The method according to claim 1 comprising contacting the oil shale with a carbon monoxide/water mixture in the presence of dawsonite, one or more dawsonite decomposition products, or a combination thereof.

16. The method according to claim 1 wherein at least one liquefaction promoter is selected from the group consisting of dawsonite, dawsonite decomposition products, sodium aluminate, water soluble metal compounds, and combinations thereof.

17. The method according to claim 16 wherein the liquefaction promoter is added at a concentration of 0.001 to 1 mol/Kg of oil shale.

18. The method according to claim 1 further comprising removing the hydrocarbons produced from the formation through one or more production wells.

19. The method according to claim 1 wherein the mixture further comprises hydrogen.

20. The method according to claim 19 wherein the hydrogen is formed in situ.

21. The method according to claim 1 wherein the ratio of water to exposed kerogen is no greater than about 1.01.

22. The method according to claim 1 wherein the ratio of water to exposed kerogen is less than 1.

23. The method according to claim 1 wherein when step (b) is performed the first time, at least a portion of at least one liquefaction promoter is already present in the formation before processing.

24. The method according to claim 1 wherein when step (b) is performed the second or subsequent time, at least a portion of at least one liquefaction promoter is added to the formation.

25. The method according to claim 1 wherein at least a portion of at least one liquefaction promoter used in step (b) is obtained by solution mining the formation.

26. The method according to claim 1 wherein the formation is heated to a temperature from about 250° C. to about 350° C.

27. The method according to claim 1 wherein the formation is heated to a temperature from about 300° C. to about 325° C.

28. The method according to claim 1 wherein the heat is sufficient for the carbon monoxide and the water to form carbon dioxide and hydrogen.

29. The method according to claim 1 wherein the heat is sufficient to decompose dawsonite.

30. A method of in-situ processing of a subterranean oil shale formation containing nahcolite to produce hydrocarbons comprising removing the nahcolite by solution mining to produce rubblized oil shale and creating a high temperature and high pressure reactor within the subterranean oil shale formation and (a) contacting the oil shale with a mixture comprising carbon monoxide and water, and (b) contacting the oil shale with one or more liquefaction promoters, under pressure and heat to produce hydrocarbons.

* * * * *